US011434069B2

(12) United States Patent
Grip

(10) Patent No.: US 11,434,069 B2
(45) Date of Patent: Sep. 6, 2022

(54) CORNER FITTINGS FOR MODULAR CONTAINERS

(71) Applicant: THE BOEING COMPANY, Chicago, IL (US)

(72) Inventor: Robert Erik Grip, Rancho Palos Verdes, CA (US)

(73) Assignee: THE BOEING COMPANY, Chicago, IL (US)

( * ) Notice: Subject to any disclaimer, the term of this patent is extended or adjusted under 35 U.S.C. 154(b) by 124 days.

(21) Appl. No.: 16/720,148

(22) Filed: Dec. 19, 2019

(65) Prior Publication Data

US 2021/0188533 A1 Jun. 24, 2021

(51) Int. Cl.

| | |
|---|---|
| ***B65D 90/00*** | (2006.01) |
| ***B65D 88/02*** | (2006.01) |
| ***B65D 88/12*** | (2006.01) |
| ***B65D 88/14*** | (2006.01) |

(52) U.S. Cl.

CPC ..... *B65D 90/0006* (2013.01); *B65D 88/027* (2013.01); *B65D 88/121* (2013.01); *B65D 88/14* (2013.01); *B65D 90/008* (2013.01)

(58) Field of Classification Search

CPC ..... B65D 2585/68; B65D 2585/687; B65D 88/06; B65D 88/02; B65D 90/0006; B65D 88/027; B65D 88/121; B65D 88/14; B65D 90/008; B65D 2590/0066; B65D 88/022; B65D 90/0026; B65D 90/00; B65D 88/12; B65D 88/10

See application file for complete search history.

(56) References Cited

U.S. PATENT DOCUMENTS

| | | | | |
|---|---|---|---|---|
| 3,563,403 A * | 2/1971 | Luisada | ..... | B65D 88/14 220/1.5 |
| 3,598,273 A * | 8/1971 | Rau | ..... | B65D 88/14 220/1.5 |
| 3,706,392 A * | 12/1972 | Sprick | ..... | B65D 90/008 220/812 |
| 3,711,902 A | 1/1973 | Eggert, Jr. | | |

(Continued)

FOREIGN PATENT DOCUMENTS

| | | |
|---|---|---|
| FR | 2732313 A1 | 10/1996 |
| GB | 2485333 A | 5/2012 |
| WO | 2010106367 A2 | 9/2010 |

OTHER PUBLICATIONS

European Patent Office Extended European Search Report for Application No. 20211436.9-1016 dated Nov. 5, 2021.

*Primary Examiner* — Kareen K Thomas

(74) *Attorney, Agent, or Firm* — Patterson + Sheridan, LLP

(57) ABSTRACT

Certain aspects of the present disclosure provide for modular containers with specialized corner fittings. In one example, a container, includes: six sides; and eight corner fittings, wherein each respective corner fitting of the eight corner fittings comprises: a first outward face on a first side of the six sides; a second outward face on a second side of the six sides; a third outward face on a third side of the six sides; and a corner fitting aperture in at least one of the first outward face, second outward face, or third outward face and centered approximately 3.379 inches from a first edge of the respective corner fitting and approximately 3.379 inches from a second edge of the respective corner fitting.

20 Claims, 11 Drawing Sheets

(56) References Cited

U.S. PATENT DOCUMENTS

| | | | | |
|---|---|---|---|---|
| 3,966,075 | A * | 6/1976 | Schultz | B65D 88/005 220/1.5 |
| 4,695,184 | A | 9/1987 | Robishaw et al. | |
| 4,759,668 | A * | 7/1988 | Larsen | B60P 3/08 410/24 |
| 4,819,820 | A * | 4/1989 | Weiner | B65D 88/022 220/1.5 |
| 6,010,021 | A | 1/2000 | Zuidam et al. | |
| 6,299,008 | B1 * | 10/2001 | Payne | B65D 88/121 220/1.5 |
| 10,308,424 | B2 | 6/2019 | Vancampen | |
| 10,947,036 | B2 | 3/2021 | Helou, Jr. | |
| 2007/0000921 | A1 * | 1/2007 | Butler | B65D 88/528 220/1.5 |
| 2017/0283114 | A1 | 10/2017 | Marschall | |
| 2018/0194548 | A1 | 7/2018 | Helou, Jr. | |

* cited by examiner

CORNER FITTINGS FOR MODULAR CONTAINERS

INTRODUCTION

Aspects of the present disclosure relate to corner fittings for modular cargo containers, and in particular to modular sub-ISO containers that may be used with existing ISO compatible connection equipment.

Cargo containers are moved about the world by various types of crafts, such as trucks, ships, trains, and aircraft. In order to facilitate shipment of goods in a global economy, standards for shipping containers have been developed. So-called "ISO" containers are containers with standardized outer dimensions as well as standardized fitting locations so that containers may reliably be carried from place to place by various types of crafts with complementary container retainers.

Unfortunately, the high-degree of standardization in container size and fitting locations means that smaller containers, which may be a better fit physically and economically for various types of cargo, are not usable with standardized container carriers, such as the aforementioned crafts. Accordingly, there is a need for modular containers that come in a wider variety of sizes while maintaining compatibility with existing cargo container fitting standards.

BRIEF SUMMARY

Certain embodiments provide a container, comprising: six sides; and eight corner fittings, wherein each respective corner fitting of the eight corner fittings comprises: a first outward face on a first side of the six sides; a second outward face on a second side of the six sides; a third outward face on a third side of the six sides; and a corner fitting aperture in at least one of the first outward face, second outward face, or third outward face and centered approximately 3.379 inches from a first edge of the respective corner fitting and approximately 3.379 inches from a second edge of the respective corner fitting.

Further embodiments provide an agglomerated container, comprising: a plurality of modular containers, wherein: each respective modular container of the plurality of modular containers comprises: six sides; and eight corner fittings, wherein each respective corner fitting of the eight corner fittings comprises: a first outward face on a first side of the six sides; a second outward face on a second side of the six sides; a third outward face on a third side of the six sides; and a corner fitting aperture in at least one of the first outward face, second outward face, or third outward face and centered approximately 3.379 inches from a first edge of the respective corner fitting and approximately 3.379 inches from a second edge of the respective corner fitting.

Further embodiments provide a method of forming an agglomerated container, comprising: connecting a plurality of modular containers to form an agglomerated container, wherein each respective modular container of the plurality of modular containers comprises: six sides; and eight corner fittings, wherein each respective corner fitting of the eight corner fittings comprises: a first outward face on a first side of the six sides; a second outward face on a second side of the six sides; a third outward face on a third side of the six sides; and a corner fitting aperture in at least one of the first outward face, second outward face, or third outward face and centered approximately 3.379 inches from a first edge of the respective corner fitting and approximately 3.379 inches from a second edge of the respective corner fitting.

The following description and the related drawings set forth in detail certain illustrative features of one or more embodiments.

BRIEF DESCRIPTION OF THE DRAWINGS

The appended figures depict certain aspects of the one or more embodiments and are therefore not to be considered limiting of the scope of this disclosure.

To facilitate understanding, identical reference numerals have been used, where possible, to designate identical elements that are common to the drawings. It is contemplated that elements and features of one embodiment may be beneficially incorporated in other embodiments without further recitation.

DETAILED DESCRIPTION

Figure 1A:
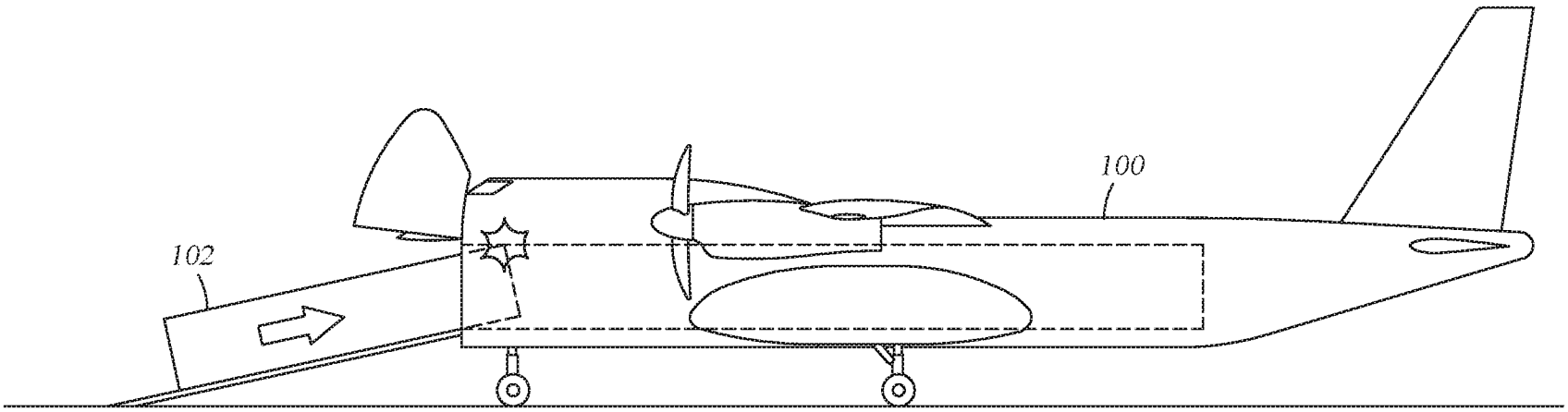
FIGS. 1A and 1B depict examples of loading large ISO containers on to an aircraft.

Aspects of the present disclosure provide modular container apparatuses and methods of using the same.

Cargo carrying crafts, such as trucks, ships, trains, and aircraft move a great amount of cargo around the world. In order to do so efficiently, standardized container sizes and fittings have emerged to allow for efficient intermodal shipping.

Amongst the most commonly used container configurations in the world are the 20-foot and 40-foot "ISO" containers. Because of their common use, cargo carrying crafts, such as trucks, trailers, and rail cars, are generally configured with container retainers that match complimentary container fittings on 20 and 40-foot containers. In some cases, larger containers, such as 45-foot, 48-foot, and 53-foot containers may still be carried by the same sort of craft using fittings that adhere to the 40-foot standard.

A shortcoming of larger ISO containers, such as 20 and 40-foot containers, is that cargo frequently must be "broken down" and reconsolidated into smaller loads along its route between origin and destination. As an example of this issue, consider a manufacturer of televisions in in a first location. In a given day, the manufacturer may produce enough TVs to fill an ISO container (e.g., a 20 or 40-foot ISO container). The ISO container is then loaded onto a truck, which takes it to a port, where it may be loaded onto a ship. At a destination port, the ISO container is unloaded from the ship, and then placed onto a truck or a train. However, at some point, the ISO container full of TVs must be unloaded and its contents separated and resorted because few customers may have a need for a whole ISO container full of TVs. For example, a retail store may want ten TVs at a time, not two hundred. This unloading and reloading takes time and energy, and thus reduces the efficiency of the shipping process. Further, this unloading and reloading increases the opportunities for damage and/or theft while in transit.

A related problem is the "less-than-load" problem. For example, a significant fraction (perhaps one-third) of cargo-carrying trucks carry containers with cargo from more than one shipper. This is because many shippers or customers do not have enough cargo to fill a whole container. Consequently, shippers commonly arrange for a "freight forwarder" or "third party logistics" company to consolidate the cargo from two or more customers into a single container (e.g., an ISO container), so that a carrying craft (e.g., a truck) moves a full load. However, this consolidation process requires time, energy, and cost, and thus reduces the efficiency of the shipping process.

Further, large ISO cargo containers pose special challenges to certain types of cargo-carrying craft. For example, 20 and 40-foot ISO containers are difficult to load into an aircraft because of the large external dimensions of the containers and relatively constrained internal dimensions of the aircraft. For this reason, aircraft have conventionally used specially designed unit load devices (ULDs), which may be in the form of a pallet or container used to load luggage, freight, and mail on both wide-body and narrow-body aircraft. ULDs allow a large quantity of cargo to be bundled into a single unit, which reduces unit load count and saves ground crews time and effort. However, such ULDs have no mechanism for working with other intermodal cargo carrying vehicles. For example, ULDs cannot connect to ISO-standard connectors on trucks or trains, and so cargo in ULDs needs to be offloaded from the ULDs into ISO-compatible containers and vice versa several times in any shipment. Here again, this takes time and exposes the cargo to more opportunities for damage.

FIG. 1A depicts an example of a challenge in loading a 40-foot container 102 into aircraft 100. As depicted, the container 102 cannot be loaded using a ramp, despite the special purpose retracting nose of aircraft 100, because it will impact the interior of the cargo area of aircraft 100. Consequently, special machinery, such as lifting cart 104 in FIG. 1B, must be used to load and offload large cargo containers, such as ISO containers. Unfortunately, the requirement for specialized loading and unloading machinery means that aircraft, such as aircraft 100, can only be loaded and unloaded at airports that have such equipment. Getting and maintaining such equipment at many airports is costly and logistically complex.

Further, the large size of container 102 allows weight to be distributed unevenly across the area of container 102, which may negatively affect the center of gravity and thus performance of aircraft 100. For example, experimentation has shown that a 40-foot cargo container with uneven load may move the center of gravity of a cargo aircraft as much as ten feet, and a 20-foot cargo container may move the center of gravity as much as one and a half feet. Moving the center of gravity of an aircraft may negatively affect flight characteristics of the aircraft, such as stability and controllability. Further, movement of the center of gravity beyond an optimal location may require actively trimming the aircraft's aerodynamic surfaces to counter the center of gravity shift, which may lead to more drag, higher fuel usage, and slower flight.

Smaller standardized shipping containers exist, such as a "Bicon" container, which fits two containers in the space of a standard 20-foot ISO container, a "Tricon" container, which fits three containers in the space of a standard 20-foot ISO container, and a "Quadcon" container, which fits four containers in the space of a standard 20-foot ISO container. However, there are many issues with these existing containers that make them economically undesirable for modular shipping.

First, Bicons, Tricons, and Quadcons require special hardware to connect to each other's corner fitting in order that the connected containers may still use standard ISO corner fittings. Critically, each of the corner fittings used for connecting adjacent containers is often not available for retaining the containers. Further, the special hardware adds weight, time, and cost to the use of such containers.

Second, Bicons, Tricons, and Quadcons need an approximate 3 inch gap between each container to accommodate the special connection hardware. The gap between the connected containers reduces the strength of the connected containers as a single structure because shear and loads run through the connectors instead of being shared by abutted walls of the containers.

Third, even though, for example, the Quadcon container is much smaller than a 20-foot ISO container, it is generally not small enough to relieve the less-than-load problem described above. For example, if a manufacturer produces a retail product such as an appliance that can be shipped in a box that has a volume of one cubic foot, a forty-foot container can carry approximately 3,000 of them; a 20-foot container can carry 1,500; and a Quadcon container can carry about 350. Thus, even the smallest of the standardized containers may carry far more cargo than needs to be shipped to any one location.

Fourth, Bicons, Tricons, and Quadcons have large tare weights because they are generally made of steel (being designed for rough duty in the military). While robust, the heavy tare weight of these containers makes them less efficient—which is especially problematic when carrying them on an aircraft. For these reasons, Bicon, Tricon, and Quadcon containers have not gained commercial acceptance.

Example Corner Fitting System for Using Smaller Containers with Existing ISO Container Retainers In order to use smaller containers with existing connection equipment (e.g., retainers) found in or on cargo carrying craft and that conform to ISO standards (e.g., ISO 668, 1161, and 1496), the corner fittings of smaller containers may be modified so that when multiple small containers are arranged together, they conform to the ISO standard. The modification of the corner fittings is beneficial because it allows smaller containers to be more easily used in multimodal transport while still maintaining the ability to use existing ISO retainer geometries. Herein, a container smaller than a twenty-foot ISO standard container may be referred to as a "sub-ISO container."

Figure 1B:
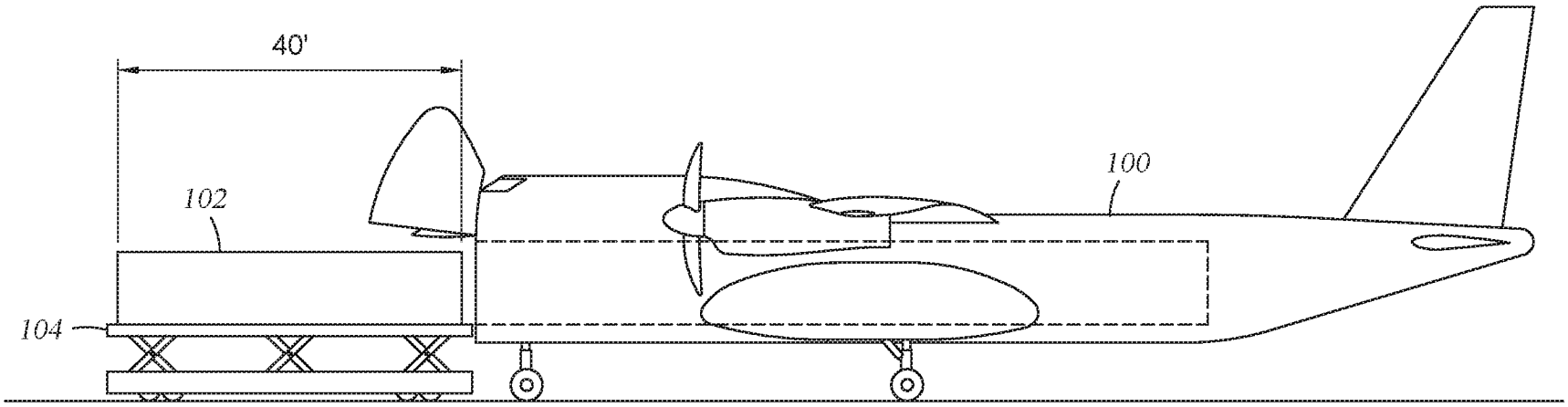

For example, sub-ISO containers (e.g., 8-foot containers) are easier to load into and offload from an aircraft (alleviating the problems discuss used above with respect to FIGS. 1A and 1B). However, once offloaded for ground transportation, it is beneficial to be able to load the sub-ISO containers onto other modes of transport, such as onto trains or tractor trailers, using standard ISO retainers. The dimensions of existing smaller containers (e.g., Bicons, Tricons, and Quadcons) do not allow for this flexible use case because, when stacked side-by-side, they do not fit within the standard ISO dimensions (e.g., for 20 and 40-foot containers), and when connected by specialized connection equipment such that they can fit standard ISO connection equipment, they are heavier and in a weaker because they are no longer side-by-side.

Further, modified corner fittings allow sub-ISO containers to be symmetric along their length and width dimensions, which means that they may be placed in multiple orientations. Existing smaller containers are not symmetric in their length and width dimensions, which limits the manner in which they are arranged when loading them onto transport craft with existing ISO retainers.

Two important dimensions in the ISO standard are the distances between the center of the corner fitting apertures (alternatively referred to as holes) of a 40-foot container in both the length and width direction. According to one ISO standard, the distance in the width direction is 7 feet 4 31/32 inches, or 88.969 inches. The distance in the length dimension is 39 feet 3⅞ inches, or 471.875 inches. Further, the ISO-standard face-to-face dimension is 40 feet +0, −0.375 inches in length, and 8 feet +0, −0.1875 in width.

Figure 2:
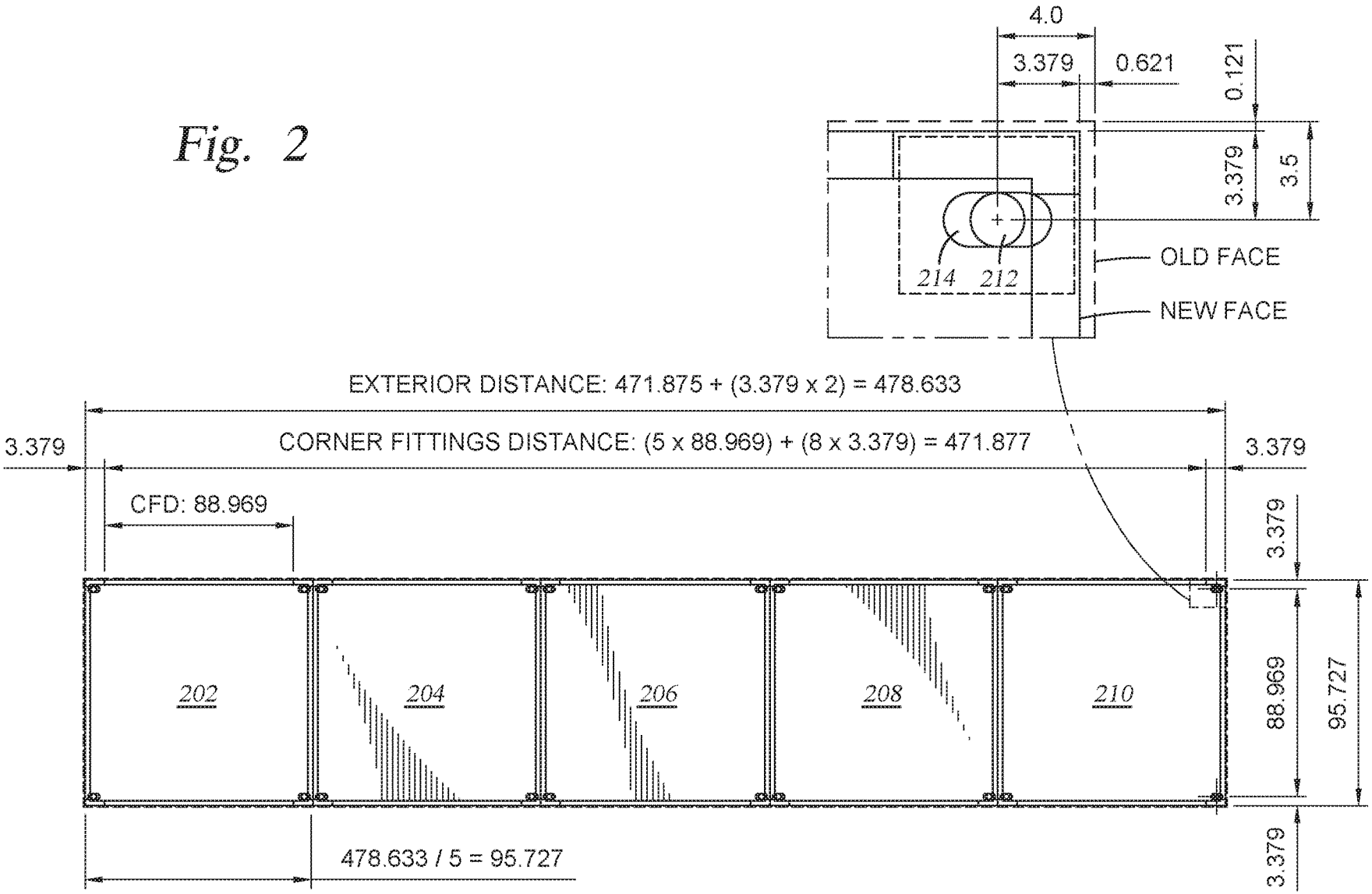
FIG. 2 depicts an arrangement of modular sub-ISO containers with modified corner fittings to maintain compatibility with ISO standard connection equipment.

FIG. 2 depicts an arrangement of modular sub-ISO containers with modified corner fittings to maintain compatibility with ISO standard connection equipment.

In this example, each modular sub-ISO container 202-210 is approximately 95.727 inches long (nominally 8-feet long) and approximately 95.727 inches wide (nominally 8-feet wide).

Further in this example, each container in the arrangement of containers includes modified corner fittings with corner fitting apertures 212 (e.g., mounting apertures) located approximately 3.379 inches from the adjacent edges of the corner fitting in the length and width directions. Notably, this is different than the ISO standard of 4 inches from the center of the corner fitting aperture to the adjacent edge in the length direction and 3.5 inches from the center of the corner fitting aperture to the adjacent edge in the width direction (as depicted by the aperture at 214). In other words, the modified corner fittings have been shaved approximately 0.621 inches in the length direction and approximately 0.121 inches in the width direction as compared to the ISO standard corner fitting. With these modified corner fitting, each of the modular containers has an outside length and an outside width of approximately 95.727 inches. This symmetry allows for the containers to be oriented in any direction when stacked side-by-side. Further, this arrangement preserves the 88.969 inches distance between the hole centers that is part of the ISO standard.

Notably, the modified corner fittings allow the five sub-ISO containers (202-210) to be arranged face-to-face in a row with an overall length of approximately 478.635 inches, which fits into the envelope of a 40-foot ISO container, which is nominally 480 inches long. Further, the distance between the centers of the corner fitting apertures for the outer-most corner fittings in the arrangement of five sub-ISO containers (202-210) is approximately 471.878 inches, which works with the standard ISO dimension of 471.875 inches for an 40-foot ISO container.

Because of their reduced dimensions, modular sub-ISO containers 202-210 can beneficially be used like ULDs in aircraft because they are significantly smaller than standard 20 and 40-foot ISO containers commonly used in other modes of shipping, such as by ship, rail, or truck. However, because modular sub-ISO containers 202-210 can be arranged (as in FIG. 2) with resulting dimensions that are compatible with ISO standard connection equipment, they can also be arranged to connect with ISO standard connection equipment (e.g., retainers) on other transport vehicle, such as ships, trains, and trucks, after being offloaded from an aircraft.

For example, the arrangement in FIG. 2 shows five sub-ISO containers 202-210 arranged to fit on any transport vehicle with 40-foot ISO-standard connection equipment. Notably, the sub-ISO containers in FIG. 2 are arranged face-to-face (alternatively, wall-to-wall), which improves the strength of the combined structure by sharing loads through the abutted faces.

Figure 3:
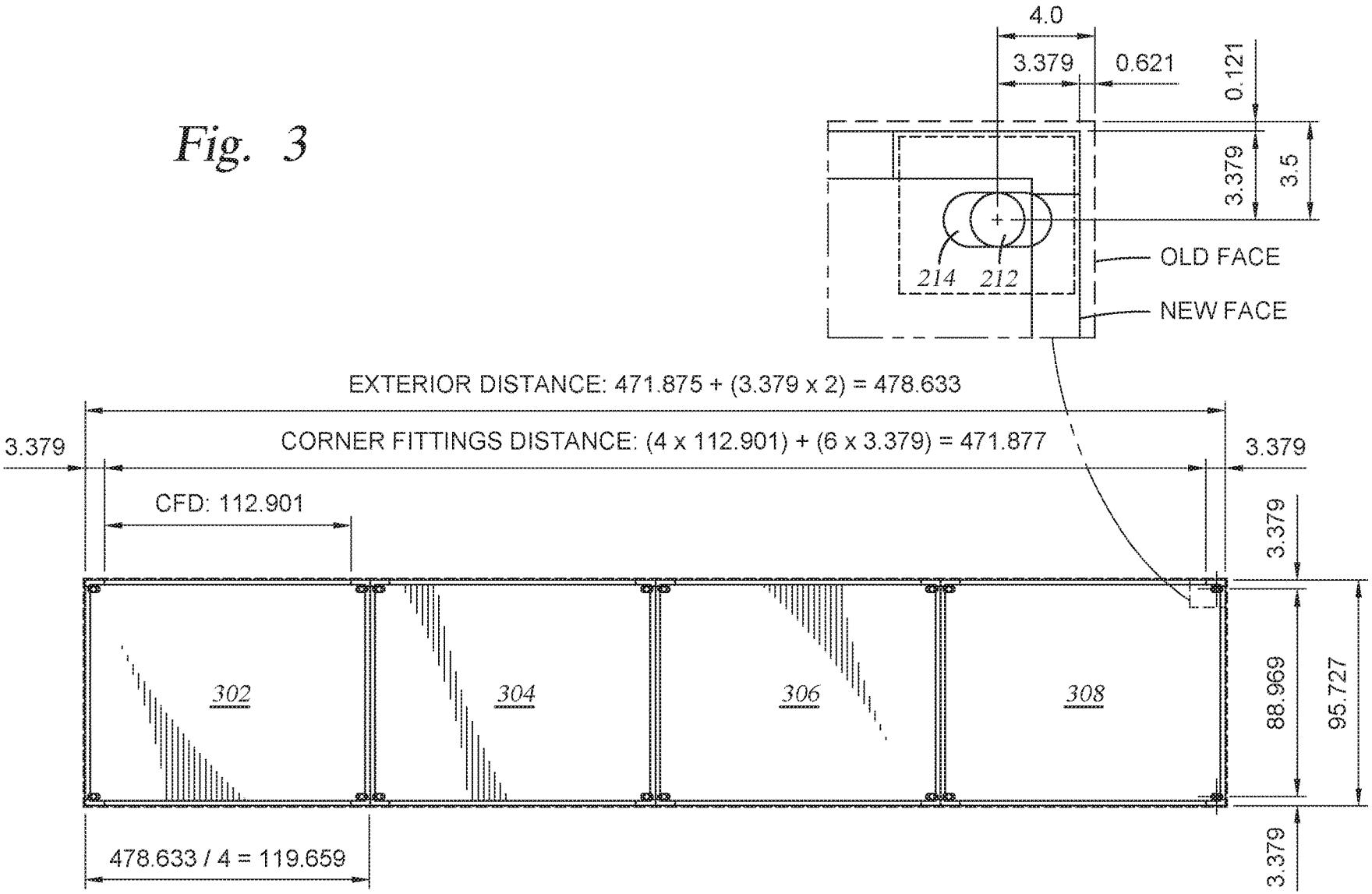
FIG. 3 depicts another arrangement of modular sub-ISO containers with modified corner fittings to maintain compatibility with ISO standard connection equipment.

Similarly, FIG. 3 depicts another arrangement of modular sub-ISO containers with modified corner fittings.

In particular, four modular sub-ISO containers (302-308), each approximately 119.659 inches long (nominally 10 feet long), are arranged to fit into the same footprint as the five 8-foot long (nominal) sub-ISO containers shown in FIG. 2. Thus the same advantages as described with respect to FIG. 2 are applicable to the arrangement of modular sub-ISO containers (302-308) as well.

The modular sub-ISO containers with modified corner fittings depicted and described with respect to FIGS. 2 and 3 have the advantage of being easier to load smaller into space constrained transport crafts, such as aircraft and smaller ships, as compared to containers that are 20-feet, 40-feet, or even 53-feet long. Because the turn-around time for aircraft is a significant driver of operating cost of the aircraft, having a container that is large, but not too large, such as a sub-ISO container as described with respect to FIGS. 2 and 3, is a significant benefit. Further, the modular sub-ISO containers can be easily transported on trucks or trains that are already configured to carry containers that conform to the ISO standard.

Modular sub-ISO containers may be fixed in the arrangements depicted in FIGS. 2 and 3 by a variety of means. For example, the modular may be connected by connectors that interface between respective container's corner fittings. Further, the modular containers may connect to existing ISO connection equipment, such as retainers on a trailer. Further yet the modular containers may be strapped down to a trailer or strapped together. These are just some examples. When connected, modular sub-ISO containers may be referred to as agglomerated containers.

Example Corner Fittings for Modular Containers

As depicted in FIGS. 2 and 3, modified corner fittings allow smaller, sub-ISO containers to be arranged in ways that maintain compatibility with ISO standard connection equipment. Such arrangements are not possible using ISO standard corner fitting designs.

Figure 4:
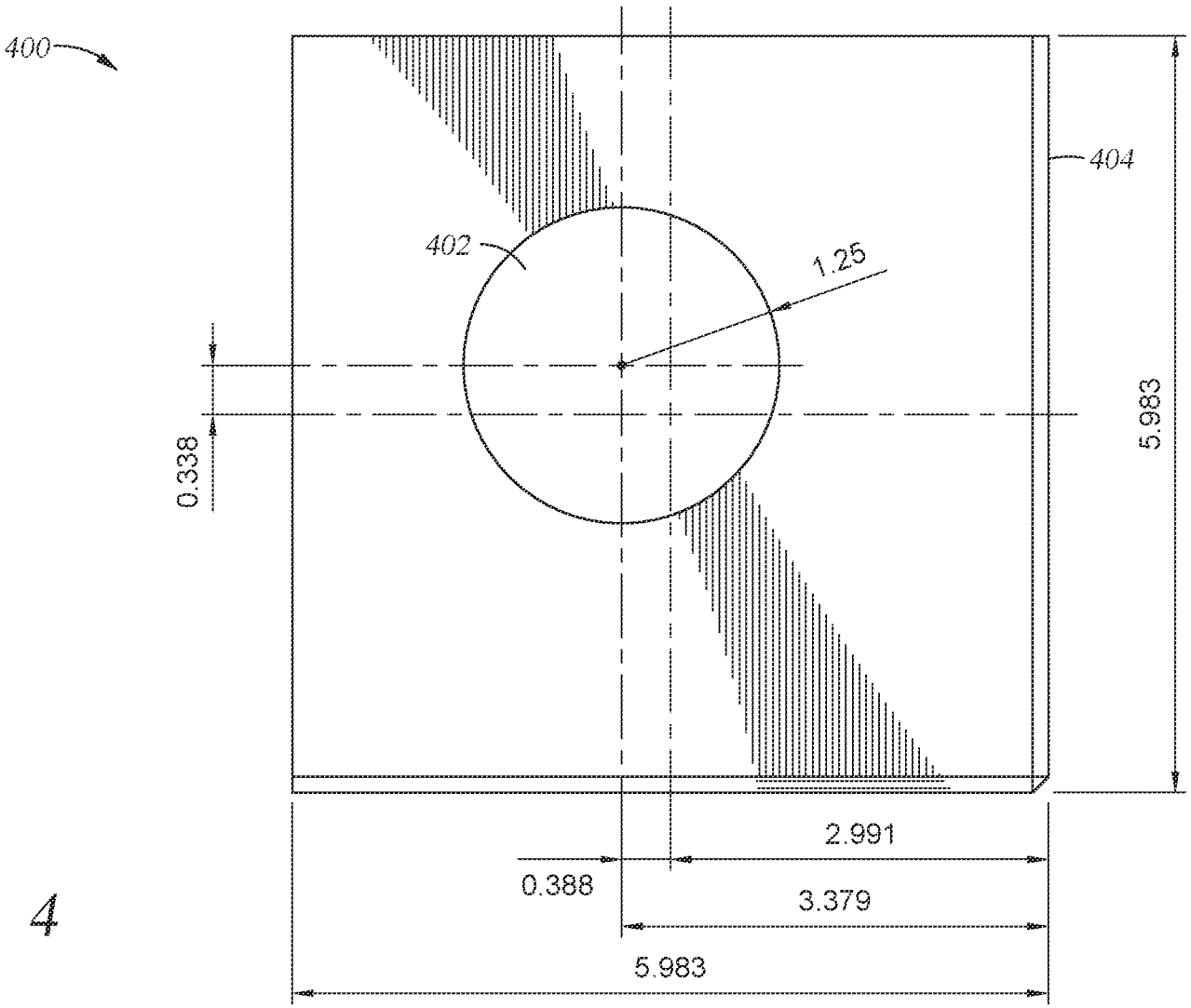
FIG. 4 depicts an example of a corner fitting 400 for use with modular containers.

FIG. 4 depicts an example of a corner fitting 400 for use with modular containers.

Generally, because corner fittings are disposed in the corners of containers, such as the modular sub-ISO containers described here, they may have six sides, including three outward facing sides and three inward facing sides. The outward facings sides may have features, such as apertures, which allow for interfacing connection and manipulation equipment with the corner fitting, such as using grappling hooks, locking connectors, chains, straps, tie-downs, and other sorts of equipment.

In this embodiment, corner fitting 400 has a height and width of 5.983 inches. Corner fitting 400 further has an aperture 402 that is centered 3.379 inches from the outward facing edge 404 of corner fitting 400, which allows for connection equipment (not depicted) to interface with corner fitting 400.

FIGS. 5A-5E depict different views of a modified ISO bottom corner fitting for use with modular containers.

Figure 5A:
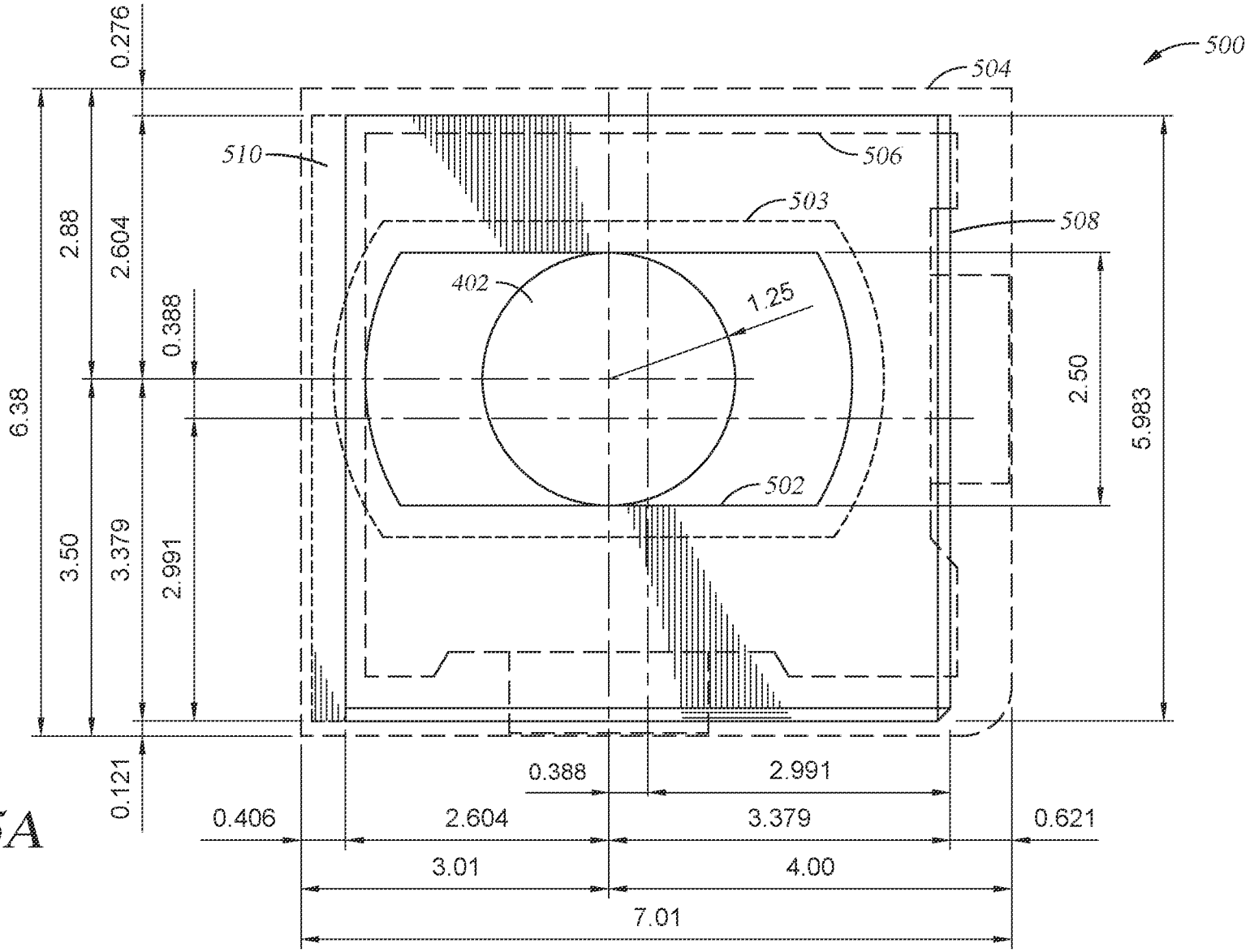
FIGS. 5A-5E depict different views of a modified ISO bottom corner fitting for use with modular containers.

In particular, FIG. 5A depicts an example of a modified bottom corner fitting 500 from a bottom view. In particular, as compared to corner fitting 400 in FIG. 4, modified corner fitting 500 includes a larger aperture 502 that is configured for use with ISO standard twist lock connection equipment. Further, modified corner fitting 500 is shown compared against the outer outline 504 and inner outline 506 of an ISO standard corner fitting.

As depicted in FIG. 5A, the modified corner fitting 500 includes a front face 508 that is reduced by 0.621 inches and a side face that is reduced by 0.121 inches, consistent with the measurements indicated in FIGS. 2 and 3. This reduction in dimension allows for sub-ISO containers to be stacked next to each other in the configurations of FIGS. 2 and 3 and maintain compatibility with ISO standard connection equipment for 40-foot ISO containers (using 8-foot sub-ISO containers as in FIG. 2) and 20 and 40-foot ISO containers (using 10-foot sub-ISO containers as in FIG. 3).

Additionally, optional extra material 510 is depicted, which may be added to modified corner fitting 500 in order to strengthen it and to allow for the central aperture 502 to be increased in size to the outline 503.

Figure 5B:
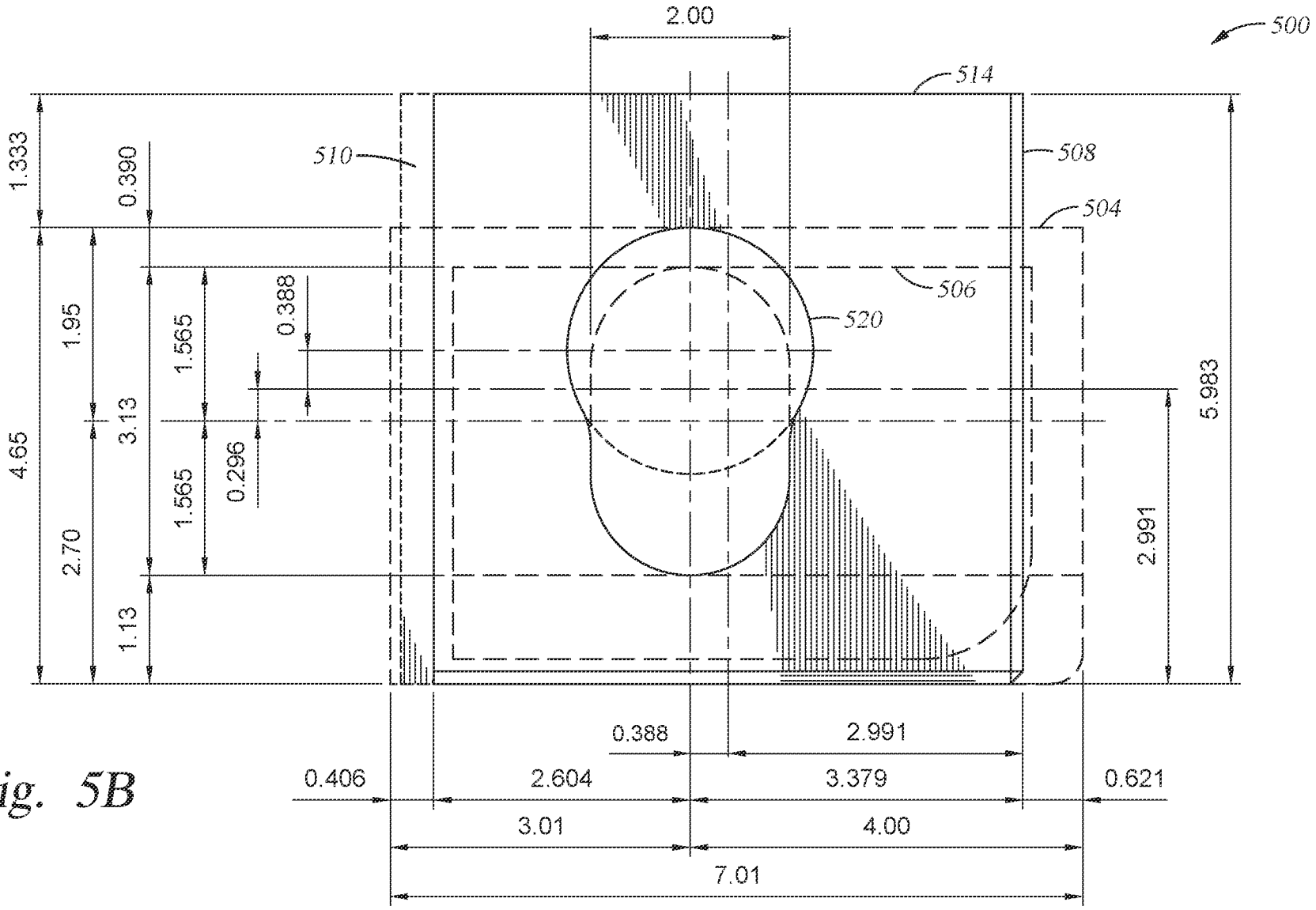

FIG. 5B depicts the modified bottom corner fitting 500 from a side view. Here again, as compared to corner fitting 400 in FIG. 4, modified corner fitting 500 includes a larger aperture 520 that is configured for use with connection and manipulation equipment, such as hooks and hoists. Further, modified corner fitting 500 is again shown compared against the outer outline 504 and inner outline 506 of an ISO standard corner fitting.

As depicted in FIG. 5B, the modified corner fitting 500 includes a front face 508 that is reduced by 0.621 inches and an inner side face 514 that is increased by 1.333 inches. Further, optional extra material 510 is depicted, which may be added to modified corner fitting 500 in order to strengthen it.

Figure 5C:
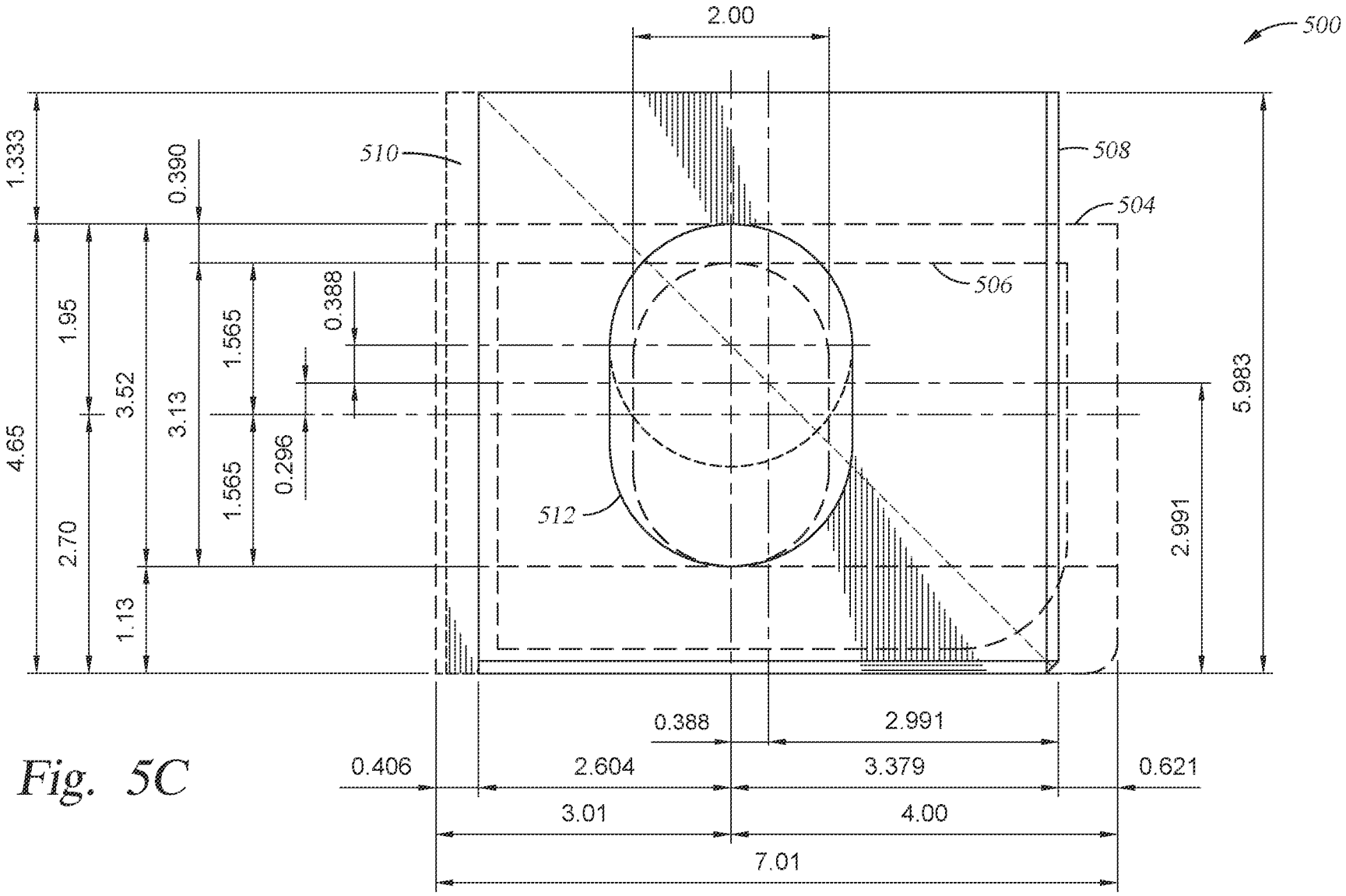

FIG. 5C depicts an alternative embodiment of the modified bottom corner fitting 500 from a side view. In this alternative embodiment, modified corner fitting 500 includes a larger pill-shaped aperture 512 that is configured for use with connection equipment and manipulation equipment.

Figure 5D:
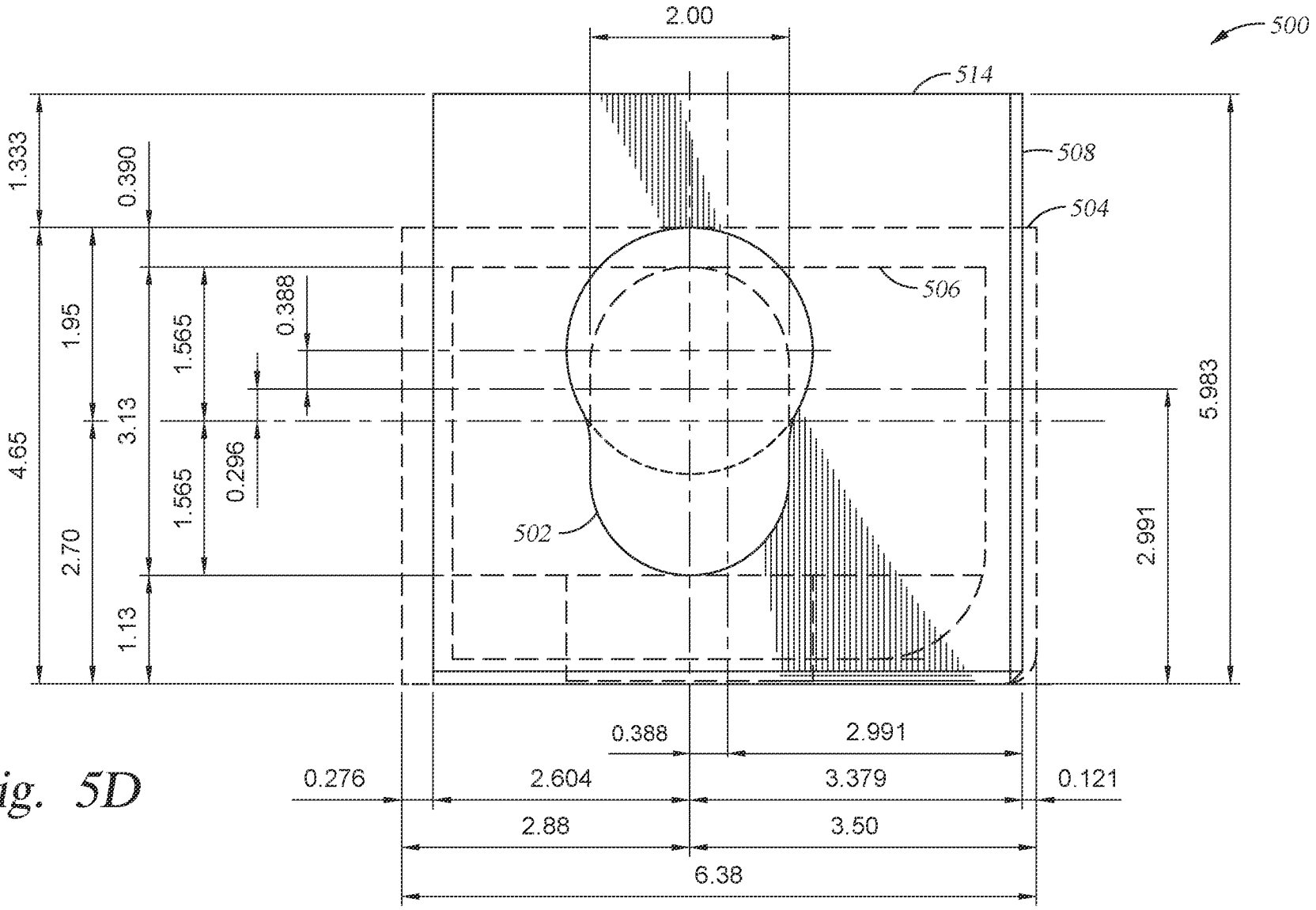

FIG. 5D depicts the modified bottom corner fitting 500 from an end view. Here again, as compared to corner fitting 400 in FIG. 4, modified corner fitting 500 includes a larger aperture 502 that is configured for use with connection and manipulation equipment. Further, modified corner fitting 500 is again shown compared against the outer outline 504 and inner outline 506 of an ISO standard corner fitting.

Figure 5E:
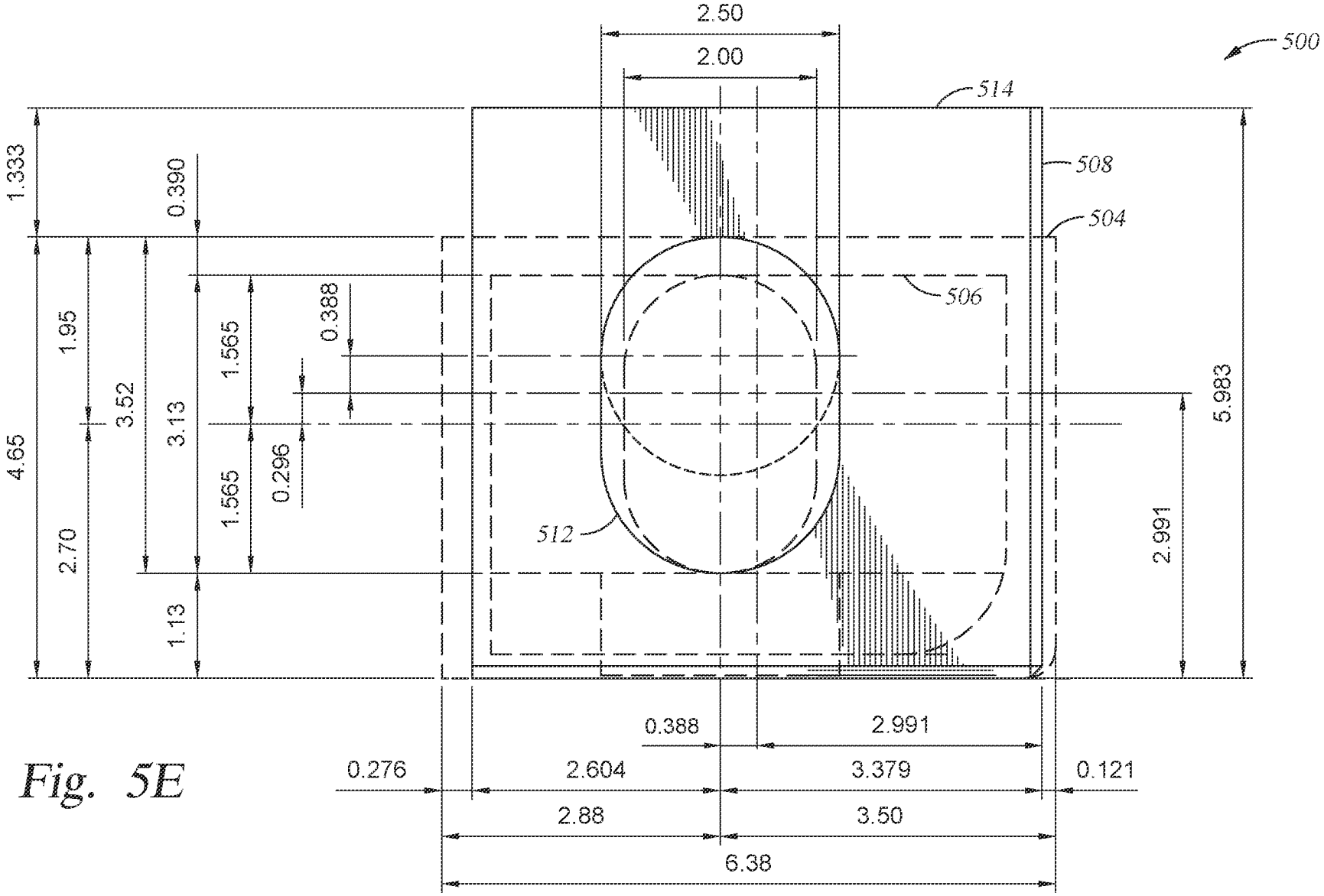

FIG. 5E depicts an alternative embodiment of the modified bottom corner fitting 500 from the end view. In this alternative embodiment, modified corner fitting 500 includes a larger pill-shaped aperture 512, as above in FIG. 5C, that is configured for use with connection and manipulation equipment.

Notably, the design of modified bottom corner fitting 500 as depicted in FIGS. 5A-5E may be mirrored to fit opposing sides or ends of a container.

Figure 6:
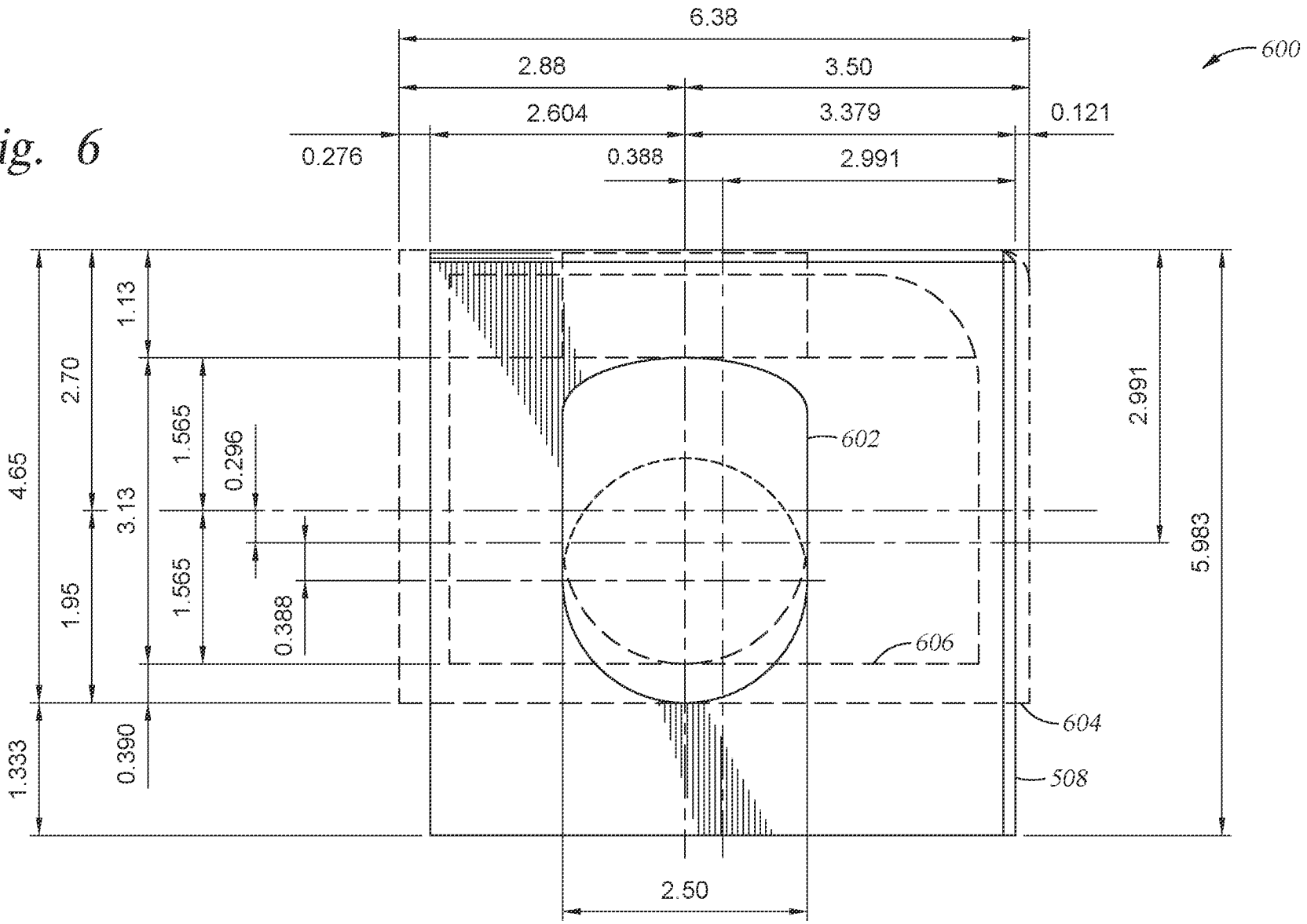
FIG. 6 depicts a modified ISO top corner fitting for use with modular containers.

FIG. 6 depicts an example of a modified top corner fitting 600 from an end view. As with modified corner fitting 500 described above, modified top corner fitting 600 includes a larger aperture 602 (compared to the aperture specified for a ISO standard bottom corner fitting) that is configured for use with ISO standard twist lock connection equipment. Further, modified corner fitting 600 is shown compared against the outer outline 604 and inner outline 606 of an ISO standard top corner fitting.

Further, as with modified bottom corner fitting 500, the design of modified top corner fitting 600 as depicted in FIG. 6 may be mirrored to fit opposing sides or ends of a container.

Example Method

Figure 7:
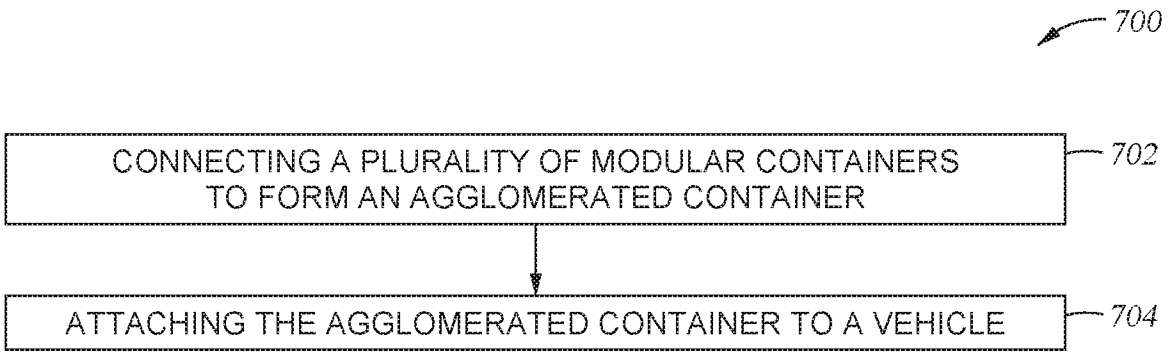
FIG. 7 depicts an example method for combining modular containers for use with ISO compatible connection equipment.

FIG. 7 depicts an example method 700 for combining modular containers for use with ISO compatible connection equipment.

Method 700 begins at step 702 with arranging a plurality of modular containers to form an agglomerated container. For example, the modular contains may be as described above with respect to FIGS. 2-6.

Method 700 then proceeds to step 704 with attaching the agglomerated container to a vehicle. In some embodiments, the agglomerated container may be connected to the vehicle via one or more ISO container retainers.

In some embodiments, multiple agglomerated containers may be connected to a plurality of ISO container retainers on vehicle (e.g., a truck, trailer, or rail car).

The preceding description is provided to enable any person skilled in the art to practice the various embodiments described herein. The examples discussed herein are not limiting of the scope, applicability, or embodiments set forth in the claims. Various modifications to these embodiments will be readily apparent to those skilled in the art, and the generic principles defined herein may be applied to other embodiments. For example, changes may be made in the function and arrangement of elements discussed without departing from the scope of the disclosure. Various examples may omit, substitute, or add various procedures or components as appropriate. For instance, the methods described may be performed in an order different from that described, and various steps may be added, omitted, or combined. Also, features described with respect to some examples may be combined in some other examples. For example, an apparatus may be implemented or a method may be practiced using any number of the aspects set forth herein. In addition, the scope of the disclosure is intended to cover such an apparatus or method that is practiced using other structure, functionality, or structure and functionality in addition to, or other than, the various aspects of the disclosure set forth herein. It should be understood that any aspect of the disclosure disclosed herein may be embodied by one or more elements of a claim.

As used herein, the word "exemplary" means "serving as an example, instance, or illustration." Any aspect described herein as "exemplary" is not necessarily to be construed as preferred or advantageous over other aspects.

As used herein, a phrase referring to "at least one of" a list of items refers to any combination of those items, including single members. As an example, "at least one of: a, b, or c" is intended to cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c or any other ordering of a, b, and c).

As used herein, the term "determining" encompasses a wide variety of actions. For example, "determining" may include calculating, computing, processing, deriving, investigating, looking up (e.g., looking up in a table, a database or another data structure), ascertaining and the like. Also, "determining" may include receiving (e.g., receiving information), accessing (e.g., accessing data in a memory) and the like. Also, "determining" may include resolving, selecting, choosing, establishing and the like.

As used herein, "approximately" with respect to a dimension means plus or minus standard manufacturing tolerances.

The methods disclosed herein comprise one or more steps or actions for achieving the methods. The method steps and/or actions may be interchanged with one another without departing from the scope of the claims. In other words, unless a specific order of steps or actions is specified, the order and/or use of specific steps and/or actions may be modified without departing from the scope of the claims. Further, the various operations of methods described above may be performed by any suitable means capable of performing the corresponding functions.

What is claimed is:

1. A container, comprising:
six sides; and
eight corner fittings, wherein each respective corner fitting of the eight corner fittings comprises:
a first outward face on a first side of the six sides;
a second outward face on a second side of the six sides;
a third outward face on a third side of the six sides; and
a corner fitting aperture in at least one of the first outward face, second outward face, or third outward face and centered 3.379 inches from a first edge of the respective corner fitting and 3.379 inches from a second edge of the respective corner fitting.

2. The container of claim 1, wherein:
the container is 95.727 inches wide, and
the container is 95.727 inches long.

3. The container of claim 2, wherein:
a distance between a center of a corner fitting aperture of a first corner fitting of the eight corner fittings and a center of a corner fitting aperture of a second corner fitting of the eight corner fittings is 88.969 inches, and
the first corner fitting and the second corner fitting share an edge of one side of the six sides.

4. The container of claim 3, wherein:
the container is 95.727 inches wide, and
the container is 119.659 inches long.

5. The container of claim 2, wherein:
a distance between any two corner fittings of the eight corner fittings arranged along a width of the container is 88.969 inches, and
a distance between any two corner fittings of the eight corner fittings arranged along a length of the container is 112.901 inches.

6. The container of claim 1, wherein each respective corner fitting of the eight corner fittings comprises a first dimension of 5.983 inches and a second dimension of 5.983 inches.

7. The container of claim 1, wherein: wherein each respective corner fitting of the eight corner fittings comprises a first dimension of 5.983 inches and a second dimension of 6.389 inches.

8. The container of claim 1, further comprising: an access door in at least one side of the six sides.

9. An agglomerated container, comprising:
a plurality of modular containers, wherein: each respective modular container of the plurality of modular containers comprises:
six sides; and
eight corner fittings, wherein each respective corner fitting of the eight corner fittings comprises:
a first outward face on a first side of the six sides;
a second outward face on a second side of the six sides;
a third outward face on a third side of the six sides; and
a corner fitting aperture in at least one of the first outward face, second outward face, or third outward face and centered 3.379 inches from a first edge of the respective corner fitting and 3.379 inches from a second edge of the respective corner fitting.

10. The agglomerated container of claim 9, wherein each of the plurality of modular containers comprises:
a width of 95.727 inches; and
a length of 95.727 inches.

11. The agglomerated container of claim 10, wherein for each respective modular container of the plurality of modular containers:
a distance between a corner fitting aperture of a first corner fitting of the eight corner fittings and a corner fitting aperture of a second corner fitting of the eight corner fittings of the respective modular container is 88.969 inches, and
the first corner fitting and the second corner fitting share an edge of one side of the six sides of the respective modular container.

12. The agglomerated container of claim 9, wherein each of the plurality of modular containers comprises:
a width of 95.727 inches; and
a length of 119.659 inches.

13. The agglomerated container of claim 12, wherein for each respective modular container of the plurality of modular containers:
a distance between any two corner fittings of the eight corner fittings arranged along a width of the respective modular container is 88.969 inches, and
the distance between any two corner fittings of the eight corner fittings arranged along a length of the respective modular container is 112.901 inches.

14. The agglomerated container of claim 9, wherein for each respective modular container of the plurality of modular containers: each respective corner fitting of the eight corner fittings comprises a first dimension of 5.983 inches and a second dimension of 5.983 inches.

15. The agglomerated container of claim 9, wherein for each respective modular container of the plurality of modular containers: each respective corner fitting of the eight corner fittings comprises a first dimension of 5.983 inches and a second dimension of 6.389 inches.

16. The agglomerated container of claim 9, wherein each of the plurality of modular containers further comprises: an access door in at least one side of the six sides.

17. A method of forming an agglomerated container, comprising:
connecting a plurality of modular containers to form an agglomerated container, wherein each respective modular container of the plurality of modular containers comprises:
six sides; and
eight corner fittings, wherein each respective corner fitting of the eight corner fittings comprises:
a first outward face on a first side of the six sides;
a second outward face on a second side of the six sides;
a third outward face on a third side of the six sides; and
a corner fitting aperture in at least one of the first outward face, second outward face, or third outward face and centered 3.379 inches from a first edge of the respective corner fitting and 3.379 inches from a second edge of the respective corner fitting.

18. The method of claim 17, wherein each of the plurality of modular containers comprises:

a width of 95.727 inches; and a length of 95.727 inches.

19. The method of claim 17, wherein each of the plurality of modular containers comprises:

a width of 95.727 inches; and a length of 119.659 inches.

20. The method of claim 17, further comprising: attaching the agglomerated container to a plurality of ISO container retainers on a vehicle.

* * * * *